US007461546B2

(12) United States Patent
Schmidt et al.

(10) Patent No.: US 7,461,546 B2
(45) Date of Patent: Dec. 9, 2008

(54) METHOD AND DEVICE FOR MEASURING AND DISPLAYING AN ENGINE OIL FILLING LEVEL IN A VEHICLE

(75) Inventors: Frank-Helge Schmidt, Stuttgart (DE); Sten-Olaf Wassmann, Remseck-Hochberg (DE)

(73) Assignee: Daimler AG, Stuttgart (DE)

( * ) Notice: Subject to any disclaimer, the term of this patent is extended or adjusted under 35 U.S.C. 154(b) by 146 days.

(21) Appl. No.: 11/516,513

(22) Filed: Sep. 7, 2006

(65) Prior Publication Data

US 2007/0056653 A1 Mar. 15, 2007

(30) Foreign Application Priority Data

Sep. 14, 2005 (DE) ..... 10 2005 043 702

(51) Int. Cl.
*G01M 15/00* (2006.01)

(52) U.S. Cl. ..... 73/114.56

(58) Field of Classification Search ..... 73/53.05, 73/114.55, 114.56, 114.57, 290 R
See application file for complete search history.

(56) References Cited

U.S. PATENT DOCUMENTS 4,768,377 A 9/1988 Habelmann et al.
4,888,576 A * 12/1989 Kubota et al. ..... 340/451
5,019,800 A * 5/1991 Gallert ..... 340/450.3
5,831,154 A 11/1998 Guertler et al.
7,000,466 B2 * 2/2006 Larson et al. ..... 73/295
7,013,225 B2 3/2006 Guertler et al.
2002/0174705 A1 * 11/2002 Berndorfer ..... 73/1.02

FOREIGN PATENT DOCUMENTS

DE 35 40 806 C2 5/1987
DE 196 02 599 C2 7/1997
DE 100 44 916 A1 3/2002
DE 101 05 889 A1 8/2002

* cited by examiner

*Primary Examiner*—Eric S McCall
(74) *Attorney, Agent, or Firm*—Crowell & Moring LLP

(57) ABSTRACT

In a method and apparatus for measuring and displaying the engine oil filling level in a vehicle having a filling level switch or sensor, measured values of the switch or sensor, in the form of determined time components, are summed to determine a state duration of a particular state of the engine oil filling level. The state duration is compared with predefined time limiting values of the respective state of the engine oil filling level. According to the invention, the length of the individual time components is determined as a function of driving-state-dependent parameters.

6 Claims, 1 Drawing Sheet

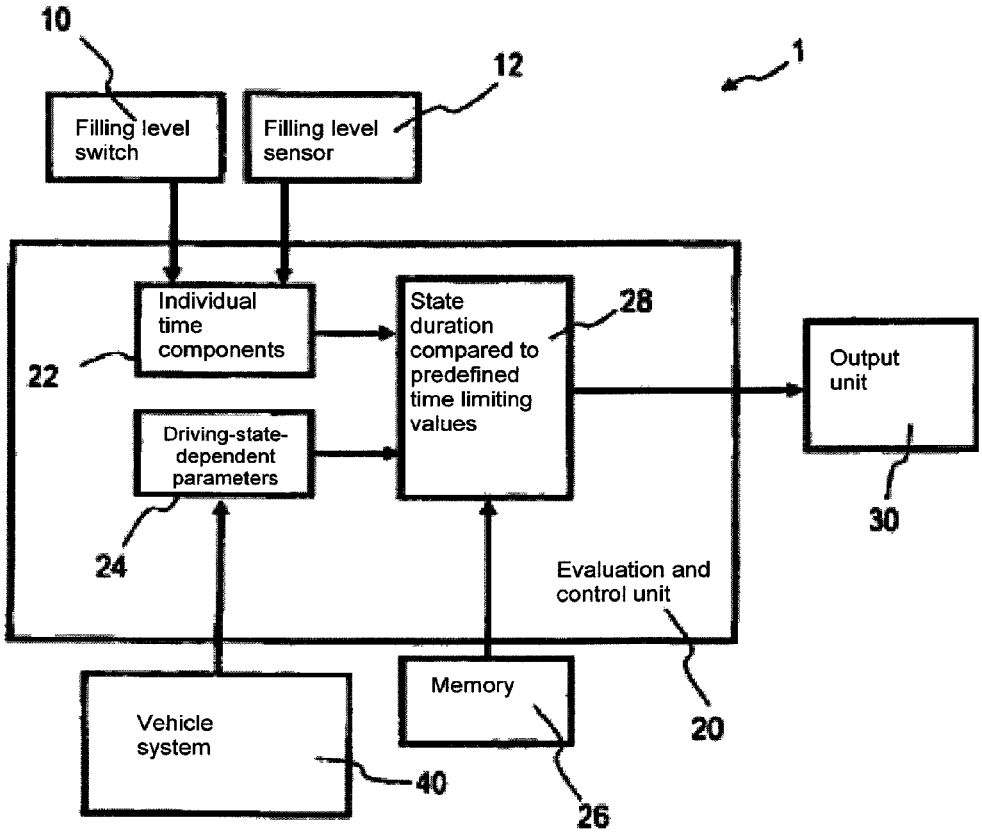
Figure

METHOD AND DEVICE FOR MEASURING AND DISPLAYING AN ENGINE OIL FILLING LEVEL IN A VEHICLE

BACKGROUND AND SUMMARY OF THE INVENTION

This application claims the priority of German patent document 10 2005 043 702.8-13, filed Sep. 14, 2006, the disclosure of which is expressly incorporated by reference herein.

The present invention is directed to a method for measuring and displaying an engine oil filling level in a vehicle.

Previously known evaluation methods for engine oil filling level monitoring systems utilize filling level switches or filling level sensors which are usually implemented as corresponding software and hardware components in the vehicle. In such methods, rigid state times are used; that is, individual time components are summed rigidly in real time in order to determine how long the determined engine oil filling level is present, and the summed duration is compared with respective time limiting values. Parameters (such as, for example, vehicle speed) which influence the engine oil filling level have hitherto been used in the evaluation methods for gating out the signals of the engine oil level monitoring systems in specific speed ranges, i.e., in order to interrupt or abort the summing of the state time, to influence the time limiting values, or to influence the measured value of the engine oil filling level, for example by correcting the temperature or rotational speed.

German patent document DE 100 44 916 A1 describes a method for measuring and displaying the oil level in a motor vehicle, which uses an oil level sensor, and the measured values are averaged over a relatively long distance. In addition, the measured value which is supplied by the oil level sensor for the oil level display or oil level warning is corrected by another measured parameter which influences the measured value. The parameters are preferably the engine speed and the oil temperature.

German patent document DE 196 02 599 C2 discloses another method for determining the amount of fluid (in particular, engine oil) in a motor vehicle. The method acquires variables which are indicative of the driving state in the driving mode, determines the instantaneous driving state therefrom, continuously acquires the instantaneous value of the filling level by means of a filling level sensor at least during selected driving states, and determines the instantaneous filling quantity from said value by means of a predefined dependence of the quantity of fluid on the driving state and on the filling level. The acquired variables which are indicative of the driving state include at least the speed of the vehicle and the engine speed. The filling quantity is determined separately for a plurality of driving states with different speeds of the vehicle and engine speeds, and the quantity of engine oil is determined taking into account a consumption quantity proportion which is determined by means of a predefined consumption quantity proportion/engine oil dependence.

One object of the present invention is to provide a method and apparatus for measuring and displaying an engine oil filling level in a vehicle, which permit improved display quality of a determined engine oil filling level in all the driving states.

This and other objects and advantages are achieved by the method and apparatus according to the invention, which determines the magnitude or length of individual time components as a function of driving-state-dependent parameters. The determined individual time components are then summed to determine the duration of a particular engine oil filling level to form a state duration. The latter is then compared with predetermined time limiting values of the respective state of the engine oil filling level.

The method according to the invention can thus use, for example, rigid time limiting values. For example, an oil level warning can be issued if the engine oil filling level lies below a predefined filling level limiting value for longer than the predetermined time limiting value, for example 60 s. The individual time components of the state duration are, however, determined as input variables as a function of parameters. That is, the magnitude or length of the individual summed time components in which a specific engine oil filling level is present are dependent on the driving state.

The inventive determination of the state duration as a function of driving-state-dependent parameters permits the display quality of a determined engine oil filling level to be improved or enhanced in all driving states in the engine operating mode, i.e., reliable, stable and precise detection of the current engine oil filling level is made possible. In addition, as a result of the method according to the invention with variable state time components, cost-effective oil level switches are used and the display quality is nevertheless enhanced. Driving trials have shown that a significant increase in the display quality can already be achieved solely by using speed-dependent state time components.

In one refinement of the method according to the invention, the driving-state-dependent parameters are calculated as weighting factors. In order to determine the magnitude or length of the respective time component, the weighting factors are multiplied by a real time value determined for the respective time component. If the state duration is determined as an input variable (for example, as a function of the speed of the vehicle), an individual state time component with a predefined factor is calculated, for example, for each real time component if the engine oil filling level lies below the filling level limiting value at a determined current speed. The sum of the time components that are collected in this manner is formed and compared with the respective time limiting values.

The driving-state-dependent parameters comprise, for example, the speed of the vehicle, engine speed, engine oil temperature, engine load moment, engine torque, longitudinal acceleration, lateral acceleration or pedal value.

In one refinement of the method according to the invention, the driving-state-dependent parameters are stored as continuous or noncontinuous functions in a memory. That is, for each parameter value there is a factor by which the real time component is multiplied in order to determine the state time component.

In a further refinement of the method according to the invention, the time components are adapted continuously by means of the driving-state-dependent parameters.

The device according to the invention for measuring and displaying the engine oil filling level in a vehicle includes a filling level switch or a filling level sensor and an evaluation and control unit which sums measured values of the filling level switch or sensor, to determine the duration of a respective state of the engine oil filling level in the form of determined time components to form a state duration, and compares it with predefined time limiting values of the respective state of the engine oil filling level. In order to determine driving-state-dependent parameters, the evaluation and control unit acquires information from at least one vehicle system and evaluates it in order to determine the magnitude or length of the individual time components as a function of the determined driving-state-dependent parameters.

The method and apparatus according to the invention permit simple and cost-effective evaluation while simultaneously improving the display quality of the engine oil filling level.

Other objects, advantages and novel features of the present invention will become apparent from the following detailed description of the invention when considered in conjunction with the accompanying drawings.

BRIEF DESCRIPTION OF THE DRAWINGS

The single FIGURE is a schematic block diagram of a system for measuring and displaying the engine oil filling level in a vehicle according to the invention.

DETAILED DESCRIPTION OF THE DRAWINGS

As is illustrated in the FIGURE, a device 1 for measuring and displaying the engine oil filling level in a vehicle comprises a filling level switch 10 or a filling level sensor 12 and an evaluation and control unit 20. The evaluation and control unit 20 determines the duration of a particular determined engine oil filling level state in the form of individual time components in the block 22, based on measured values of the filling level switch 10 or of the filling level sensor 12. In addition, the evaluation and control unit 20 in the block 24 acquires driving-state-dependent parameters from information from at least one vehicle system 40.

In the block 28, the evaluation and control unit 20 evaluates the determined driving-state-dependent parameters and determines a magnitude or a length of the individual time components which are summed to form a state duration, that is compared with predefined time limiting values of the respective state of the engine oil filling level. The determined engine filling level is then output via an output unit 30.

In the block 28, the driving-state-dependent parameters which comprise, for example, a speed of the vehicle or an engine speed or an engine oil temperature or an engine load moment or an engine torque or a longitudinal acceleration or a lateral acceleration or a pedal value are calculated as weighting factors. In order to determine the magnitude or length of the respective time component, a real time value which is determined for the respective time component is multiplied by the driving-state-dependent weighting factor. If the driving-state-dependent parameter is, for example, the speed of the vehicle, an individual state time component can be calculated by multiplying the determined real time value by the speed-dependent weighting factor. The individual determined state time components are then summed to form the state duration and compared with the respective time limiting value.

In order to determine the driving-state-dependent weighting factor in block 28, the evaluation and control unit 20 can access a memory 26 in which the driving-state-dependent parameters are stored as continuous or noncontinuous functions. In the block 28, the time components can be influenced or adapted continuously by means of various driving-state-dependent parameters such as the speed of the vehicle, engine speed, engine oil temperature, engine load moment or engine torque, longitudinal acceleration, lateral acceleration or pedal value.

The method according to the invention permits the influences acting on the filling level at the measurement location of the filling level switch to be taken into account in terms of their effect on the time limits, the influences being mainly speed-dependent. In vehicles having an engine with a rear oil sump trays (that is, the sump region of the oil tray is located in the rear part), it is possible for the oil level to drop below the limiting value in the braking or overrun phases so that the state time components "oil level below limiting value" are summed. In the town cycle operating mode, these driving states can very easily be taken into account by using a movement dynamic parameter in the form of a pedal limiting value or load limiting value when determining the individual time components.

These overrun phases occur in the same form in the driving mode on a freeway or when traveling cross country, the overrun phases also being possibly considerably longer. However, other speed-dependent or driving-resistant-dependent pedal values or load values are present and these are taken into account when determining the individual time components.

In one particularly reliable solution, the effective longitudinal accelerations of the vehicle are determined and taken into account. Limiting values are provided in which the summing of the state time components are interrupted or aborted. In the town cycle operating mode, the relevant longitudinal accelerations occur more frequently as a function of the driving profile and in a more pronounced but shorter form. The opposite applies to freeways or when traveling cross country. Determining limiting values is correspondingly complicated and subject to compromises.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for measuring an engine oil filling level in a vehicle having a filling level switch or sensor, whose measured values in the form of determined time components are summed to form a state duration of a particular engine oil filling level, which state duration is compared with predefined time limiting values of the respective state of the engine oil filling level; wherein length of the individual time components is determined as a function of driving-state-dependent parameters.

2. The method as claimed in claim 1, wherein:

the driving-state-dependent parameters are calculated as weighting factors; and to determine the length of the respective time component, the driving-state-dependent parameters are multiplied by a real time value determined for the respective time component.

3. The method as claimed in claim 1, wherein the driving-state-dependent parameters comprise at least one of a speed of the vehicle, engine speed, engine oil temperature, engine load moment, engine torque, longitudinal acceleration, lateral acceleration, and a pedal value.

4. The method as claimed in claim 1, wherein the driving-state-dependent parameters are stored as a continuous or noncontinuous function in a memory.

5. The method as claimed in claim 1, wherein the time components are adapted continuously by means of the driving-state-dependent parameters.

6. Apparatus for measuring an engine oil filling level in a vehicle, comprising:

a filling level switch or sensor; and an evaluation and control unit which sums measured values of the filling level switch or sensor in the form of determined time components, to form a state duration of a particular state of the engine oil filling level, and compares it with predefined time limiting values of the respective state of the engine oil filling level;

wherein, in order to determine driving-state-dependent parameters, the evaluation and control unit acquires and evaluates information from at least one vehicle system and determines a magnitude or a length of the individual time components as a function of the determined driving-state-dependent parameters.

* * * * *